US009267251B2

(12) United States Patent
Adams

(10) Patent No.: US 9,267,251 B2
(45) **Date of Patent: *Feb. 23, 2016**

(54) MULTI-PART REUSABLE LEVEE BAG

(71) Applicant: Beau G. Adams, Louisville, KY (US)

(72) Inventor: Beau G. Adams, Louisville, KY (US)

( * ) Notice: Subject to any disclaimer, the term of this patent is extended or adjusted under 35 U.S.C. 154(b) by 281 days.

This patent is subject to a terminal disclaimer.

(21) Appl. No.: 13/760,594

(22) Filed: Feb. 6, 2013

(65) Prior Publication Data

US 2014/0102581 A1 Apr. 17, 2014

Related U.S. Application Data

(60) Provisional application No. 61/713,079, filed on Oct. 12, 2012.

(51) Int. Cl.
*E02B 3/10* (2006.01)
*B31B 1/74* (2006.01)

(52) U.S. Cl.
CPC .. *E02B 3/108* (2013.01); *B31B 1/74* (2013.01)

(58) Field of Classification Search
CPC ..... E02B 3/10; E02B 3/106; E02B 3/108; B65B 1/04
USPC ..... 141/10, 114, 313–317; 405/111
See application file for complete search history.

(56) References Cited

U.S. PATENT DOCUMENTS

| | | | |
|---|---|---|---|
| 1,418,403 | A | 6/1922 | Smith |
| 1,475,603 | A | 11/1923 | Sheridan |
| 1,983,418 | A | 12/1934 | Thurmer |
| 2,570,851 | A | 10/1951 | Peyser |
| 2,586,557 | A | 2/1952 | Newbold |
| 2,672,903 | A | 3/1954 | Machinist |
| 2,767,963 | A | 10/1956 | Ringen et al. |
| 2,813,704 | A | 11/1957 | MacKissic |
| 3,552,346 | A | 1/1971 | Garden |
| 3,886,751 | A | 6/1975 | Porraz Jimenez Labora |
| 4,126,213 | A | 11/1978 | McDonald |
| 4,184,522 | A | 1/1980 | Waite |
| 4,362,433 | A | 12/1982 | Wagner et al. |
| 4,650,368 | A | 3/1987 | Bayer |
| 4,674,127 | A | 6/1987 | Yamada et al. |
| 4,700,818 | A | 10/1987 | Orwin |
| 4,784,520 | A | 11/1988 | Stevens |

(Continued)

FOREIGN PATENT DOCUMENTS

| | | |
|---|---|---|
| EP | 2299003 | 3/2011 |
| JP | 11029151 | 2/1999 |

(Continued)

OTHER PUBLICATIONS

International Search Report for corresponding PCT Application No. PCT/US2013/064875 Jan. 17, 2014.

(Continued)

*Primary Examiner* — Nicolas A Arnett
(74) *Attorney, Agent, or Firm* — Middleton Reutlinger

(57) ABSTRACT

Methods and apparatus are provided related to a multi-part reusable levee bag. The reusable levee bag includes a top bag section and a bottom portion removably affixed to the top bag section. The combined top bag section and bottom portion define an in interior space within which fillable material may be received to form a levee bag for use in flooding and other installations. The multi-part design allows the levee bag, once filled, to be disassembled and reused.

36 Claims, 5 Drawing Sheets

(56) References Cited

U.S. PATENT DOCUMENTS

| | | | | |
|---|---|---|---|---|
| 5,176,468 | A * | 1/1993 | Poole | 405/23 |
| 5,244,019 | A | 9/1993 | Derby | |
| 5,425,403 | A | 6/1995 | Herrmann | |
| 5,443,102 | A | 8/1995 | Svendsen | |
| 5,509,229 | A | 4/1996 | Thomasson et al. | |
| 5,538,155 | A | 7/1996 | Hoekstra | |
| 5,584,599 | A | 12/1996 | Knittel | |
| 5,605,416 | A * | 2/1997 | Roach | 405/21 |
| 5,771,665 | A | 6/1998 | Nelson et al. | |
| 5,894,871 | A | 4/1999 | Greer | |
| 5,901,762 | A | 5/1999 | Rollins | |
| 5,971,661 | A | 10/1999 | Johnson et al. | |
| 5,988,237 | A | 11/1999 | Bedsole | |
| 6,126,362 | A | 10/2000 | Carter et al. | |
| 6,334,736 | B1 * | 1/2002 | Johnson et al. | 405/114 |
| 6,390,154 | B1 | 5/2002 | Hall | |
| 6,637,474 | B2 | 10/2003 | Hall | |
| 6,672,799 | B2 | 1/2004 | Earl | |
| 6,708,835 | B1 | 3/2004 | Mathis | |
| 6,994,132 | B2 | 2/2006 | Antrobus | |
| 7,237,753 | B2 | 7/2007 | Metcalfe | |
| 7,281,879 | B2 * | 10/2007 | Cho et al. | 405/91 |
| 7,431,534 | B2 | 10/2008 | Harbeck | |
| 7,651,298 | B2 | 1/2010 | Boudreaux, Jr. | |
| 7,708,495 | B1 | 5/2010 | Antee | |
| 7,900,757 | B2 | 3/2011 | Sisitsky | |
| 7,922,421 | B2 | 4/2011 | McGillick, Sr. | |
| 7,958,995 | B2 | 6/2011 | Dedmon et al. | |
| D655,426 | S | 3/2012 | Otten | |
| 8,235,631 | B2 | 8/2012 | Adams et al. | |
| 8,382,398 | B2 * | 2/2013 | Stauffacher et al. | 405/111 |
| 8,602,692 | B2 * | 12/2013 | Adams et al. | 405/284 |
| 8,721,221 | B2 * | 5/2014 | Cavenagh et al. | 405/114 |
| 2001/0027826 | A1 | 10/2001 | Carpenter | |
| 2006/0222270 | A1 | 10/2006 | Modena | |
| 2007/0154265 | A1 * | 7/2007 | Stauffacher et al. | 405/110 |
| 2010/0278591 | A1 | 11/2010 | Tasker | |
| 2011/0103900 | A1 * | 5/2011 | Adams et al. | 405/284 |
| 2012/0195687 | A1 | 8/2012 | Beard et al. | |
| 2012/0195695 | A1 * | 8/2012 | Adams et al. | 405/284 |
| 2012/0207406 | A1 | 8/2012 | Cavenagh et al. | |
| 2012/0230766 | A1 | 9/2012 | Schnaars, Sr. et al. | |
| 2012/0315093 | A1 * | 12/2012 | Taylor | 405/114 |
| 2013/0071188 | A1 * | 3/2013 | Taylor | 405/114 |
| 2014/0050537 | A1 * | 2/2014 | Adams et al. | 405/284 |
| 2014/0226918 | A1 * | 8/2014 | Adams | 383/1 |

FOREIGN PATENT DOCUMENTS

| | | |
|---|---|---|
| JP | 11190015 | 7/1999 |
| JP | 2000129646 | 5/2000 |

OTHER PUBLICATIONS

International Search Report and Written Opinion for corresponding PCT Application No. PCT/US2013/064873 Jul. 9, 2014.

* cited by examiner

MULTI-PART REUSABLE LEVEE BAG

CROSS-REFERENCE TO RELATED DOCUMENTS

This Application claims priority to Provisional Application 61/713,079 filed Oct. 12, 2012 and entitled Multi-Part Reusable Levee Bag, which is hereby incorporated by reference in its entirety.

TECHNICAL FIELD

Described is a multi-part reusable levee system bag. More particularly, a two piece reusable levee bag having a top and bottom bag section which are removably affixed to each other is set forth.

BACKGROUND

Flood control and levee systems have been achieved by utilizing one time use sand bags and the like. However such bags may only be used for a single installation and are labor intensive to fill. Further these bags must be stacked vertically to prevent flooding requiring labor intensive operation and are destroyed when disassembled. It is therefore desirable to utilize bags which may be automatically filled utilizing a backhoe or other machinery and which mechanizes the bag filling operation as well as using a bag which may be reused in multiple installations.

Such prior art bag filling systems have also utilized large filling sleds with a unitary bag construction which allows a larger volume bag to be filled by a mechanized process. However these large volume bags, once filled, cannot be reused and also must be destroyed once the need for the temporary levee has passed.

Thus there is a need in the art to provide a method and bag system as well as an apparatus which provides a portable and reusable levee bag. The levee bag may be filled on location and subsequent to the need for the temporary levee, may be removed, reconditioned and then reused. The methods, system and apparatus for a multi-part reusable levee bag as set forth herein may, for example, allow for reuse.

SUMMARY

The present disclosure is directed towards methods and apparatus for a multi-part reusable levee bag. The multi-part reusable levee bag is, in various embodiments, a multi-part bag which may be filled with a flowable material such as sand and which may then be emptied after use. The bag may then be reconditioned and reused. For example, a two piece bag having an upper portion and a lower portion may be connected and filled with sand utilizing a levee bag filling frame or sled. In some embodiments, the multi-part reusable bag may include a top bag section which is removably attached to a bottom bag section. The top bag section may be configured to be attached securely to the bottom bag section such that an interior enclosed space is defined which securely retains a flowable material. The filled multi-part reusable levee bag may be utilized in flood control projects, earthen support and like applications.

Generally, in one aspect, a multi-part reusable levee bag is provided for filling, emptying and reuse. The reusable levee bag includes a top bag portion with an open top and an open bottom wherein the top bag portion and open top may be dimensionally smaller than the open bottom. As well, in some variations, the top bag portion may have guides extending from a top edge of the top bag portion and the top bag portion defines an interior space. Combined with the top bag portion is a bottom bag portion which is removably retained thereto, the bottom bag portion having a first side flap extending from a bottom panel of the bottom bag portion. The bottom bag portion further may have a second side flap extending from the bottom panel. The interior space defined by the top bag portion may include at least one baffle or side panel interrupting the interior space. In various embodiments, the plurality of side panels or baffles may be intermittently positioned between first and second end panels of the top bag portion. The combined top bag portion and bottom bag portion therefore define an enclosed multi-part levee bag capable of receiving flowable material therein.

In some embodiments, the reusable levee bag top bag portion is removably retained to the bottom bag portion by a plurality of connectors.

In some embodiments, the top bag portion may also have a plurality of straps which are received within a plurality of strap receivers on the bottom bag portion.

In some embodiments, the bottom bag portion may have an end flap which extends upward towards the top bag portion.

In other embodiments, the top bag portion may have first and second opposing end panel and further may include a plurality of interposed baffles or side panels which extend from a first side of the top bag portion to a second side of the top bag portion.

In other examples, the reusable levee bag includes a plurality of baffles which extend substantially from the open top to substantially the open bottom of the top bag portion.

In various embodiments, the reusable levee bag also includes a plurality of travel guides which in still further embodiments include an ovalized head connected to the top bag portion by a narrow neck.

In some embodiments, the bottom bag portion is removably affixed to the top bag portion by a plurality of hook and loop fasteners.

In still other embodiments, the reusable levee bag includes various affixation means in order to removably attach the top bag portion to the bottom bag portion.

In still further embodiments, the reusable levee bag includes a bottom bag portion which is tray shaped and defined with a bottom panel and first and second side flaps. Further, the bottom bag portion may in other embodiments also include opposing first and second end flaps that, when the first and second side flaps and the first and second end flaps extend upward towards the top bag, may substantially surround the open bottom of the top bag portion in order to enclose the interior space defined therein.

In other embodiments, the top bag portion may be a multi-sided shape.

Still further embodiments allow the reusable levee bag to include a plurality of baffle or side panels in the top bag portion within the interior space wherein the baffle panels are similarly multi-sided in shape.

Generally, in another aspect, a reusable levee bag is provided which includes a top bag portion and a bottom bag portion, the top bag portion being removably attached to the bottom bad portion. The top bag portion may have an open top and an open bottom wherein the open top is dimensionally smaller than the open bottom. The top bag portion may be removably retained to the bottom bag portion by a plurality of removably attachable mechanisms wherein when the top bag portion and bottom bag portion are combined, the combined portions define an enclosed interior space forming a levee bag.

In some embodiments, the bottom bag portion may have a first and second side flap extending upwards towards at least a portion of the top bag portion.

In still further embodiments, the top bag portion and the bottom bag portion may be removably attached by a plurality of straps and rings.

In still other embodiments, the bottom bag portion may have at least one end flap releasably attached to the top bag portion.

In some embodiments, the reusable levee bag may further include a plurality of multi-sided shaped baffle or side panels in the enclosed interior of the top bag portion.

In still further embodiments, the reusable levee bag may further include a plurality of guides affixed to the top bag portion and configured to allow the reusable levee bag to slide along a first and second rail of a bag filling frame or sled.

Generally, in another aspect, a two piece reusable levee bag is disclosed which include a top bag section and a bottom bag section wherein the top bag section is removably affixed to the bottom bag section. The combined top and bottom bag sections form an enclosed interior space having a plurality of baffles or side panels forming individual compartments therein. The top bag section may have a narrow top opening wherein the bottom opening of the top bag section is wider than the top opening. The combined top bag section and bottom bag section therefore receive a flowable fill material which is received within the interior space. The top bag section may be adapted to be removed from the bottom bag section when the flowable fill material is within the interior space causing the flowable fill material to spill outside of the combined top and bottom bag sections.

In some embodiments, the top bag section may include a multi-sided cross section. In other embodiments, this cross section may be quadrilateral. In still further examples, this cross section may be trapezoidal or other multi-sided configuration.

In other embodiments, the top bag section may include a plurality of upwardly extending travel or channel guides.

In some embodiments the channel guides may each have an enlarged ovalized head and a neck.

In some embodiments, the bottom bag section may have a bottom panel and a first and second side flap which are affixable to the top bag section by a plurality of removably attachable fasteners.

The bottom bag section and the top bag section may also include in some embodiments a plurality of removably affixable fasteners which allow the top bag section to be securely fastened to the bottom bag section.

In still further embodiments, the top bag section includes a plurality of straps received within a plurality of correspondingly positioned strap receivers on the bottom bag section.

Other embodiments include a top bag section and a bottom bag section which have hook and loop style fasteners to removably retain the top bag section to the bottom bag section.

Generally in another aspect, a two piece reusable levee bag is disclosed and described which includes a top bag having a top opening and a bottom opening and also having front, a back and two end panels. The top opening of the top bag may be smaller than the bottom opening. Further, the two piece reusable levee bag may include a bottom section which is removably affixable to the top bag, the bottom section having a bottom panel whereby the top bag is affixed to the bottom section and whereby the combined top bag and bottom section form an enclosed interior space. The enclosed interior space may be fillable through the top opening of the top bag. The enclosed interior space may further have a plurality of baffles positioned therein and the top bag may be attached to the bottom bag by a plurality of connectors.

In some embodiments, the plurality of connectors may include a plurality of straps and combined strap receivers.

In still further embodiments, the plurality of connectors may include hook and loop type fasteners.

In still further embodiments, the enclosed interior space may be capable of being filled with a flowable material through the top opening.

In further embodiments, the top bag may be removable from the bottom section after the interior space is filled with the flowable material.

In another aspect, a method is detailed for forming a multi-part levee bag which includes forming a multi-sided shaped top bag having first and second end panels and first and second side panels. The method includes interposing a plurality of baffle panels in between the end panels to create separate compartments therein. The top bag and bottom portion may be removably affixed together by folding at least one side flap of the bottom section against a side panel of the top bag, the combined top bag and bottom portion forming an interior space adapted for receiving filling material therein.

Generally in another respect, a method of filling a reusable bag is provided which includes removably attaching a top bag to a bottom bag portion, the top bag having an open top and an open bottom, the open bottom substantially covered by the removable bottom bag portion. At least one side flap of the bottom portion is folded to a first side of the top bag to affix it thereto. The combined bag may be slidably affixed to a bag filling frame thereby allowing the combined bag to be expanded to define an interior space which is substantially quadrilateral or multi-sided in shape. The expanded multi-part bag may be slid into a bag filling frame to allow filling material to be deposited into the substantially interior space. The filled multi-part bag may then be removed from the frame for use.

It should be appreciated that all combinations of the foregoing concepts and additional concepts discussed in greater detail below provided such concepts are not mutually inconsistent are contemplated as being part of the inventive subject matter disclosed herein. In particular, all combinations of claimed subject matter appearing at the end of this disclosure are contemplated as being part of the inventive subject matter disclosed herein. It should be also appreciated that terminology explicitly employed herein but may also appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, and emphasis instead generally placed upon illustrating the principals of the invention.

DETAILED DESCRIPTION

Levee bags may be filled and installed in various locals and for multiple purposes. These filling operations and bag designs typically are minimal in nature or do not allow for reuse of the levee bags. Previous levee bag systems have typically been filled and left in place and then destroyed upon passing of the need for the levee bags. Thus, Applicants recognize and appreciated the need for a multi-part reusable levee bag which may be easily filled in place and, after filling and use, may be disassembled, reconditioned and reused. For example, a reusable multi-part levee bag may be utilized in a flood location and, after the need for the levee bag has passed, the levee bag may be disassembled and reused. The multi-part reusable levee bag set forth herein, for example, includes various structures for disassembly of the filled levee bag since typical levee bag systems, once filled, must be destroyed in order to remove the levee bag from the filled position.

More generally, Applicants have recognized the need for a multi-part reusable levee bag system which may be filled in position and which may be disassembled and reused at a later time.

In view of the foregoing, various apparatus and methods are disclosed herein which relate to the use, filling and construction of a multi-part reusable levee bag.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatus and methods may be omitted so as not to obscure the description of the representative embodiments. Such methods and apparatus are clearly within the scope of the claimed invention. For example, various embodiments of the apparatus disclosed herein are particularly suited for a multi-part reusable levee bag with a particular orientation for construction as well as geometric shape. Accordingly, for illustrative purposes, the description included herein is often discussed in conjunction with particular implementations described in the figures. However, other configurations of the multi-part reusable levee bag are contemplated without deviating from the scope or spirit of the claimed invention.

Figure 1:
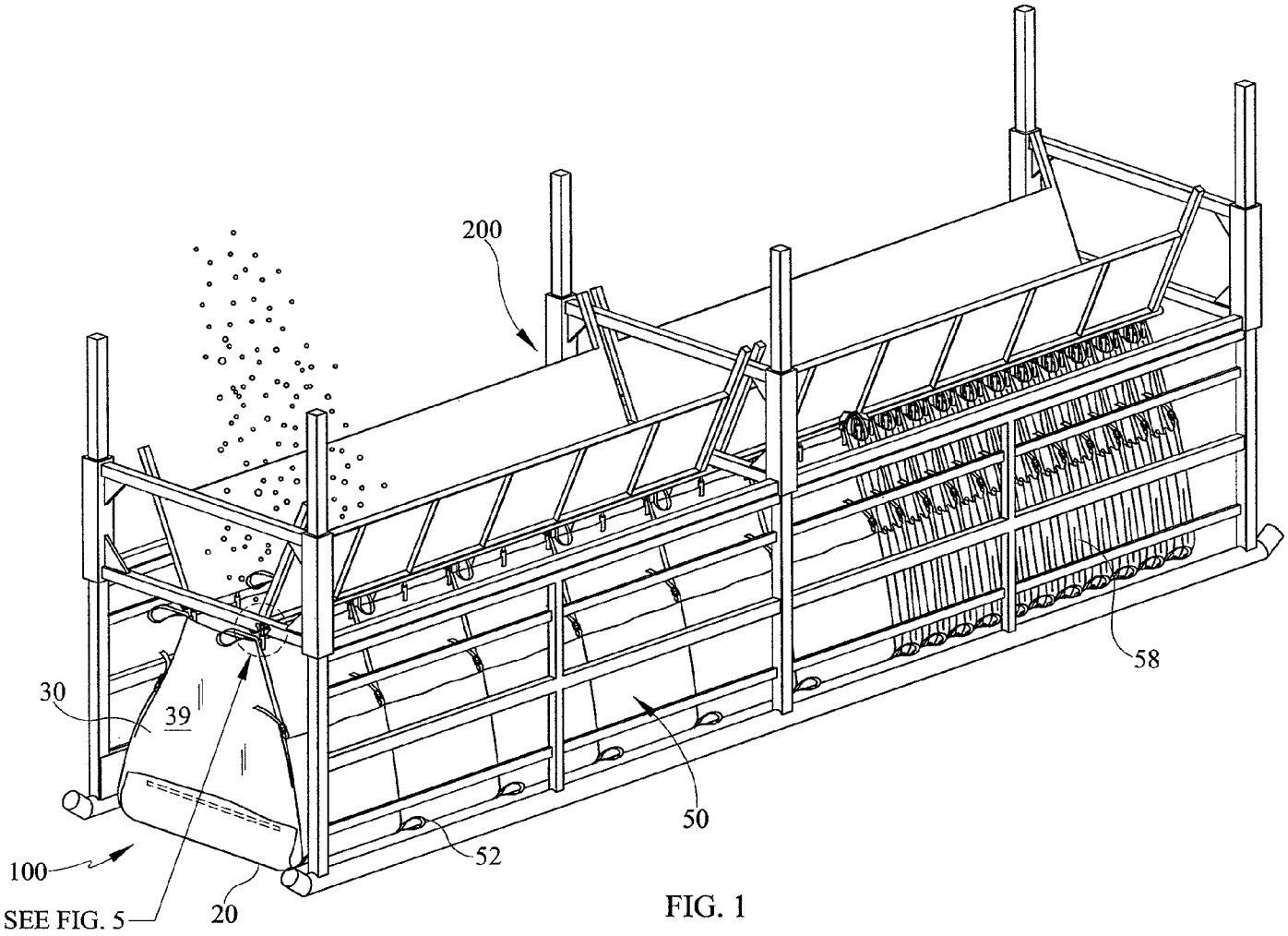
FIG. 1 illustrates the multi-part reusable levee bag retained within a bag filling frame or sled.

FIG. 1 details a multi-part reusable levee bag 100 which is positioned within a bag filling frame or sled 200. As disclosed and set forth within the fill operation depicted within FIG. 1, the multi-part reusable levee bag 100 is positioned in a fill station where the expanded section 50 is expanded for receiving a fill material such as sand and the like. The reusable levee bags 100 further includes, as depicted within FIG. 1 and the embodiment thereof, a collapsed section 58 which is compressed in accordion fashion and which may be expanded as the filling operation proceeds.

In some embodiments the bag 100 may be installed within the bag filling frame or sled 200 and a backhoe or other machine may scoop material into the filling frame and fill the bags as they are expanded into the expanded section 50. Thus, high speed filling of the bags may be implemented.

Figure 2:
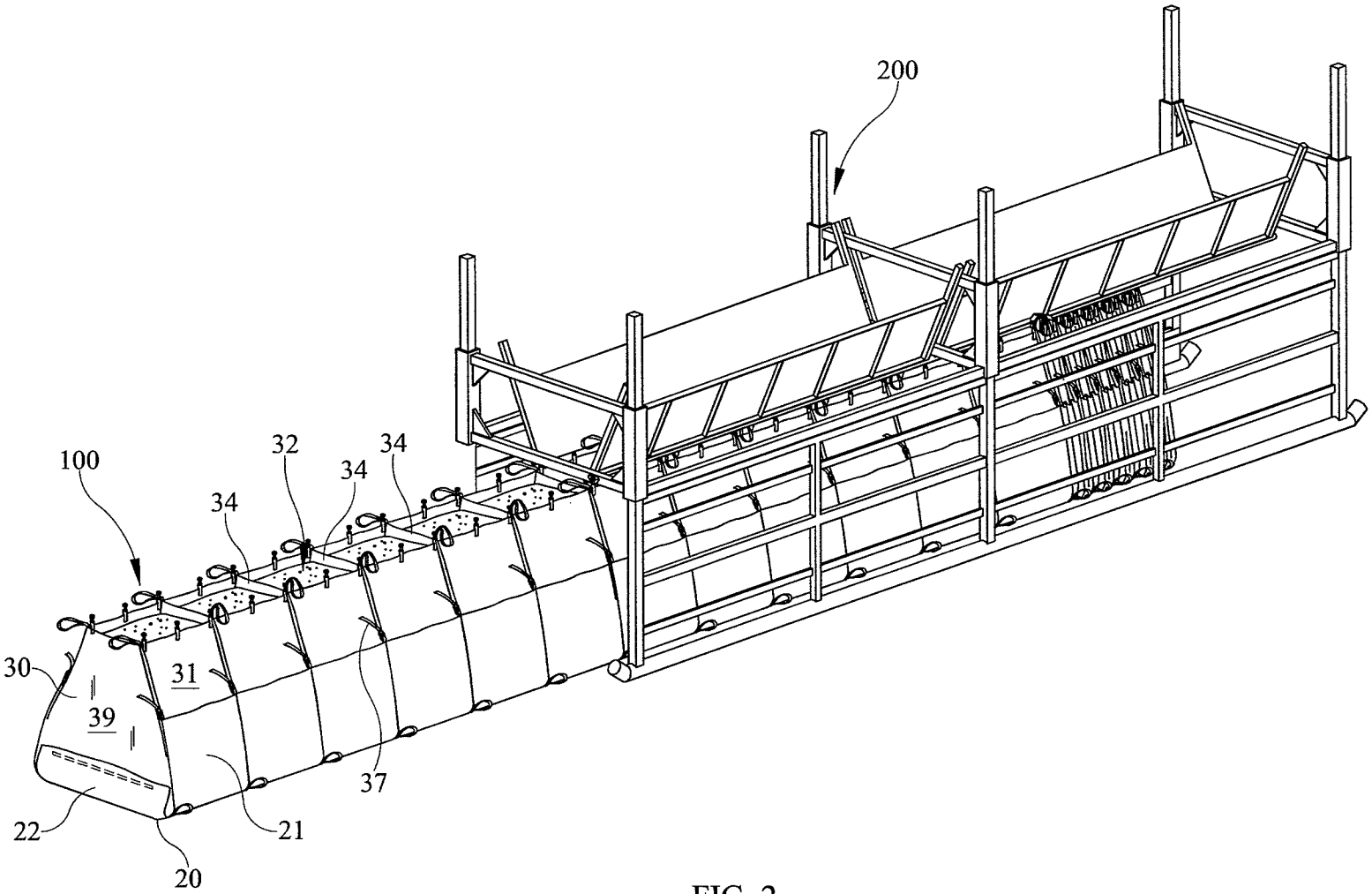
FIG. 2 illustrates a multi-part reusable levee bag partially filled with fillable material.

FIG. 2 depicts a partially filled bag 100 in which the frame 200 has been retracted from the filled portions of the reusable levee bag. Reusable levee bag 100 may include an upper section 30 and a lower section 20 which are removably assembled together to form an interior space within which the fill material is firmly positioned. As shown in FIGS. 1 and 2, once filled, the reusable multi-part levee bag 100 may be disassembled by disconnecting the various connector mechanisms attaching the top bag portion 30 to the bottom bag section 20 thereby allowing the fillable material to flow exterior to the assembled bag and the bag portions subsequently removed.

Figure 3:
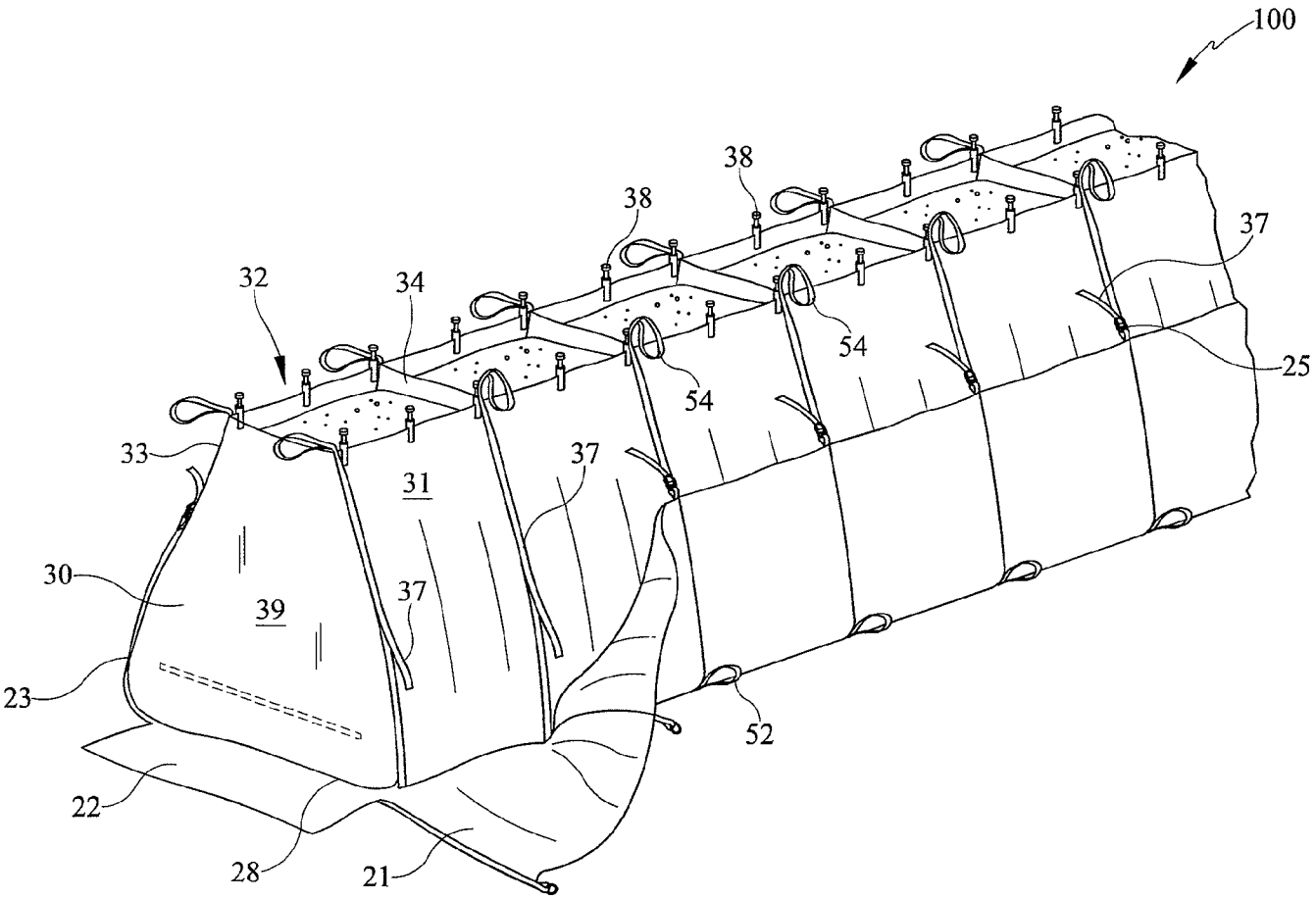
FIG. 3 illustrates a partially disassembled view of the multi-part reusable levee bag exposing the interior of the bottom bag section.
Figure 4:
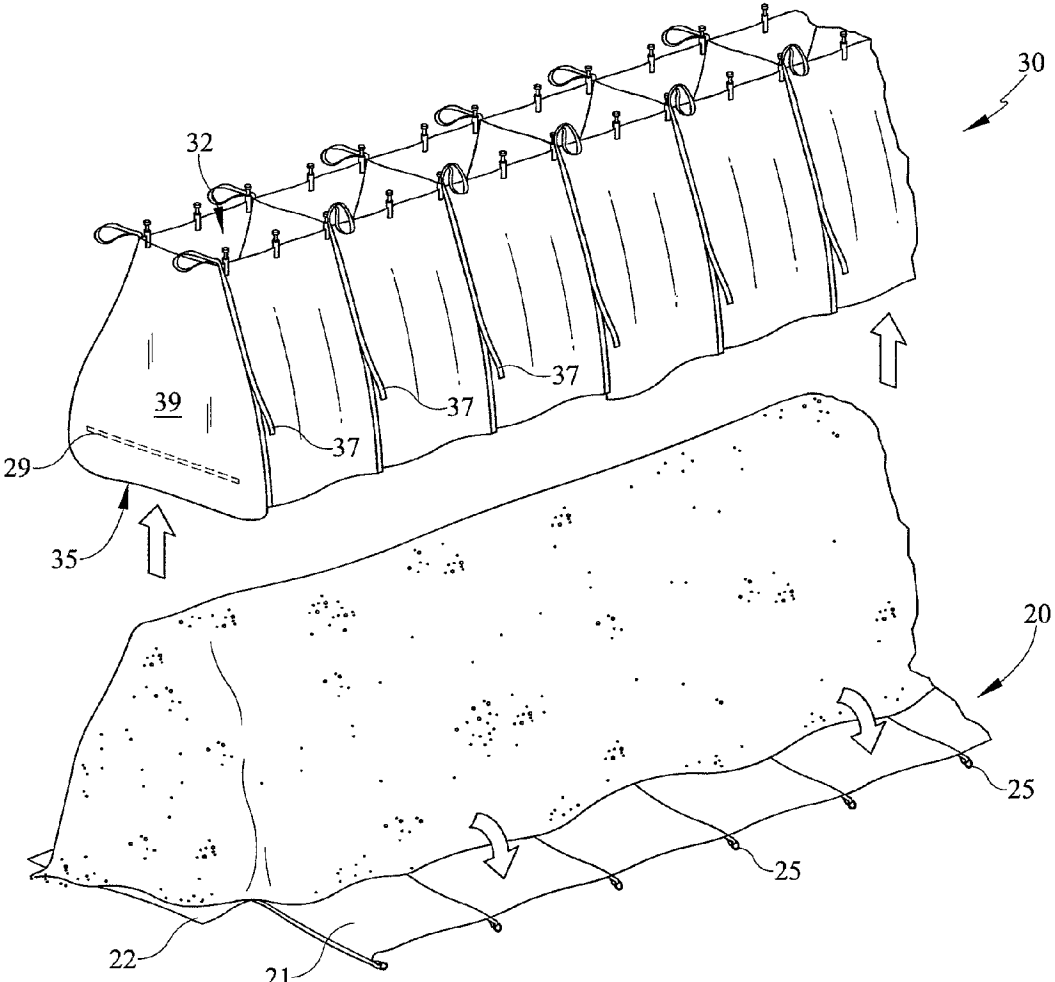
FIG. 4 is a disassembled view of the multi-part reusable levee bag wherein the top bag is removed from the bottom bag section and the fillable material is exposed.

As further shown in FIGS. 3 and 4, the top bag section 30 includes an end panel 39 as well as an opposing end panel not shown in this view. At least one baffle or side panel 34 is interposed between opposing end panels. As well, a first side panel 31 and a second side panel 33 define an open top 32 and an open bottom 35. In some embodiments, the open top 32 is dimensionally smaller or narrower than the open bottom 35. End panel 39 may be positioned on a first end with the opposing end panel being a corresponding side panel. Further, the plurality of baffle panels or side panels 34 may be regularly intermittently positioned between end panels to form individual compartments which extend the length of the top bag 30 as well as reusable multi-part bag 100.

Top bag portion 30 may have opposing end panels 39 with a plurality of baffle or side panels 34 interposed therein and connecting the first side 31 and the second side 33 such as for example the front and rear surfaces of the bag 100. Use of such multiple compartments formed within the interior of the top bag 30 provides the filled bag with a solid constitution and allows the multiple compartments to be individually filled while also preventing the material from flowing out should a single compartment be torn or otherwise exposed.

The top portion 30 may also include a plurality of guides 38 extending upward from, in some embodiments, both the first side panel 31 and the second side panel 33. Other connection points may as well be implemented such as placing guides along top edges of end panels, side panels or baffles or any other relevant position.

Figure 5:
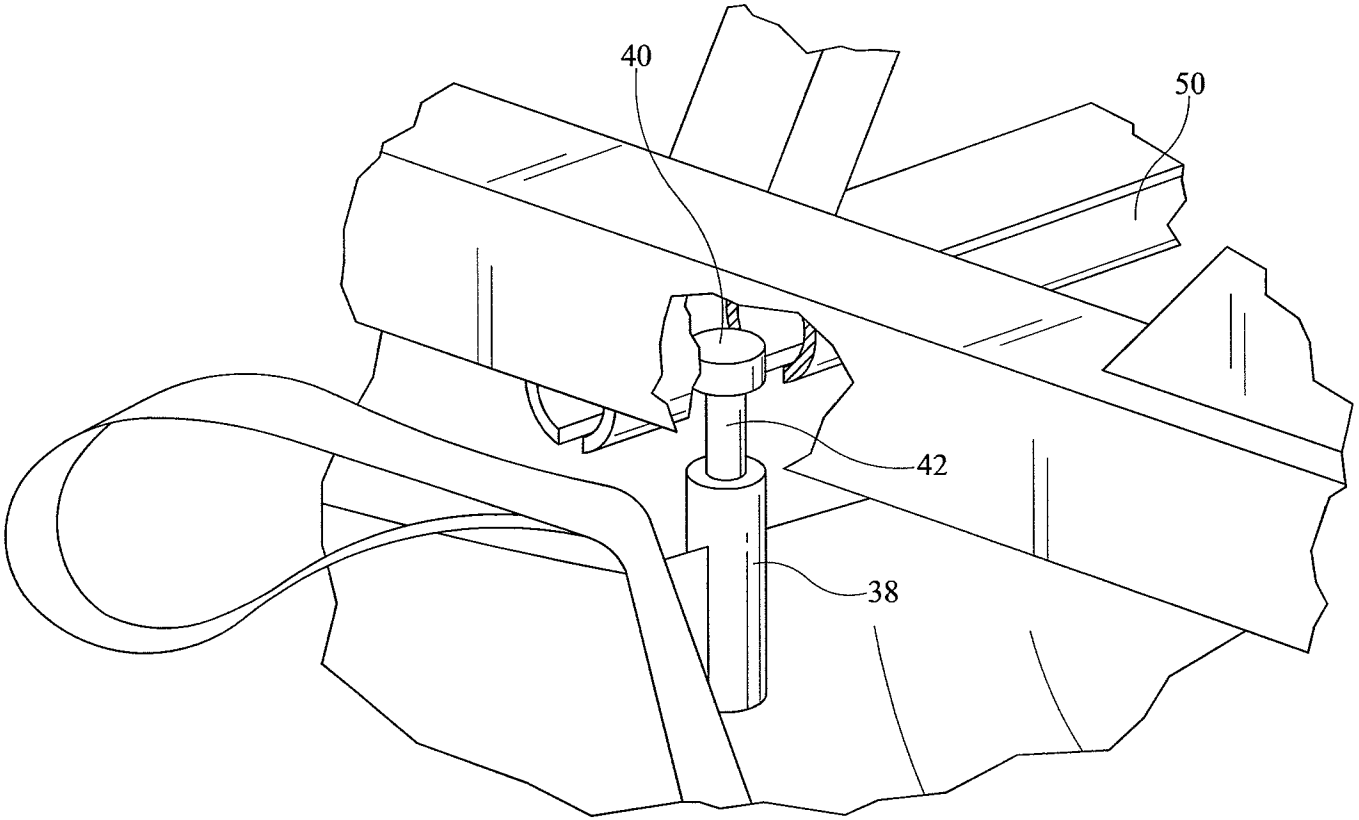
FIG. 5 illustrates a close up view of one alternative guide structure allowing the reusable levee system bag to be slidably affixed to a bag filling frame.

As shown and depicted in the various embodiments of the figures, the guides extend from a top edge of the side panels and include, as shown in FIG. 5, a guide head 40 and a guide neck 42 which allows the guide to slide along a first and second channel 50 of the bag filling frame 200. Various other guide mechanisms may be utilized apart from the specific guides depicted herein and particularly, alternative constructions of guides which allow the bag to slide along any bag filling frame or sled may be utilized. Such implementation of the particular guide shown in the figures is not to be construed as limiting as many other constructions are available to be utilized to accomplish sliding of the top bag and multi-part levee bag within a frame.

Returning to FIGS. 3 and 4, the top bag 30 includes the end panel 39 shown in the figure and having opposing first and second side panels 31, 33. The end panels and first and second side panels in combination with the baffles or side panels 34 form an interior space in which the fillable material may be deposited. The top bag further has an open top 32 and open bottom 35, the open bottom substantially closed off by the bottom section 20 and bottom panel once connected to the top bag 30. The bottom panel of the bottom section generally is in alignment with the open bottom 35 of the top bag 20. In various embodiments, the bottom section 20 may include first and second side flaps which extend up upward on the exterior surface of the top bag portion 30 so that the D-rings 25 are accessible to the straps 37. However, many other constructions are available for positioning of the bottom section 20 in general alignment with the open bottom to effectively seal the open bottom of the top bag from dispensing fill material.

The bottom bag is, in various embodiments, removably attached to the top bag 30 by various removable attachment mechanisms and may be, in one embodiment, connected by a plurality of straps 37. The straps 37 may depend or extend on an exterior surface of the top bag and be received within strap receiving mechanisms 25. The strap receiving mechanisms may include rings, D-rings, loops or other structure and as well, the position of the straps and strap receiving mechanisms may be interchanged. For example, the straps may extend upwards from the bottom section to be received at the top bag or other configurations to effectively connect the two sections together.

Various known removable attachment mechanisms or connectors may be interposed between the top bag 30 and the bottom bag portion 20 such that the top bag portion may be removably affixed and attached to the bottom bag portion in order to define an interior space which may receive fillable material and which allows the top bag to be removed and separated from the bottom bag after filling. Such removable attachment mechanisms or connectors allow the top bag to be securely affixed to the bottom bag during the filling operation and during use and may include straps, hook and loop fasteners, mechanical buttons, zip systems, temporary stitching, fold lines, flaps or other structure. Various such connectors, removable attachment structures or removable affixation means may be implemented to removably affix the top bag to the bottom bag and the embodiments shown herein are provided to exemplify one variation of removably attachable mechanisms to removably attach the two portions together.

As shown in the figures, the top bag has an open top 32 and an open bottom 35 wherein the open bottom is larger in diameter or area or dimensionally larger than the open top 32. In the depicted embodiment, the larger opening at the bottom allows more ready dispensing of the interior fillable material contents of the multi-part bag once disassembly and detachment of the two portions is completed. As well, in various embodiments, similar sized openings for the top and bottom of the top bag portion may be implemented. Narrowing of the upper entry area or open top of the top bag as compared to the open bottom area of the top bag is not necessary in order to effectuate a multi-part reusable levee bag as described and illustrated herein.

The open bottom of the top bag may be closed off with the bottom portion 20, the bottom portion 20 including a central bottom panel 28 and first and second side flaps 21, 23 both of which extend upward towards the open top of the top bag portion. The first and second side flaps may be wrapped on an exterior or interior surface of the top bag and is designed to effectively close off the open bottom 35 of the top bag and prevent significant dispensing of the flowable material once contained into the interior area of the multi-part bag. By wrapping the side flaps 21,23 around the walls of the top bag, flowable material within the compartments of the assembled bag does not leak through when the bag is submerged or exposed to water or current. Alternatively, and in various embodiments, an end flap 22 may also be provided which may be folded up along the bottom edge of the end panel 39 of the top bag and be secured thereto in order to prevent leakage of the fillable material out of the lower edge of the end panel 39. Such end flap 22 may be connected to the end panel 39 by hook and loop type fasteners, buttons, straps or other removably affixable mechanisms. End flap 22 may as well be constructed in alternative embodiments as a V-shaped configuration to receive between each V-shaped panel the end panel 39 of the top bag. By including the end panel 39 of the top bag into a V-shaped end flap 22 of the bottom bag portion 20 or a single end flap, as shown in the various embodiments, securement of the end panel 39 of the top bag and prevention of leakage for sand or other flowable material occurs. Such various alternatives of the removably affixable mechanisms may be utilized throughout the construction of the multi-part reusable levee bag illustrated herein in combination with other functionally similar structures.

As illustrated in the various embodiments depicted within the figures, the top bag 30 may have a generally multi-sided or quadrilateral cross-sectional shape which utilizes a narrower top and a wider bottom in order to increase the stability of the filled multi-part reusable levee bag. The construction of the levee bag as shown in the various embodiments may as well increase the ability of the top bag 30 to be lifted away from the bottom bag section 20 once the levee bag has been used. The bag cross section may be quadrilateral, multi-sided or alternative shape. As well, in various constructions, the bags may be various cross sections. In some examples, this cross section may be multi-sided. However, such is merely exemplary and provided for explanatory purposes only. Further, among the multiple embodiments and examples provided, it is merely meant, among other non-limiting examples, that the cross sectional shape may generally be square, a convex quadrilateral with at least one pair of parallel sides and may also include a five or more sided polygon. As set forth in the various depicted embodiments, a multi-sided top bag is disclosed with a smaller length top edge as compared to bottom edge. However, alternative constructions having non-parallel edges or mating walls may be implemented. Alternatively, however, in some embodiments the bag may have more than four sides and may be a complex shaped, five or more sided configuration.

Other constructions and shapes may be utilized for the top bag 30 and the cross-sectional shape depicted herein and within the figures is merely used for explanatory purposes only. No limiting interpretation of the specific geometric dimension and shapes shown in the figures is to be read into the appended claims or interpreted as being necessary to accomplish the various structures and methods of the apparatus disclosed herein. Such alternative constructions include square, triangular, rectangular and other geometric configurations allowing the interior of the combined top and bottom bag portions to be filled.

In use and as provided in this example, the top bag 30 and the bottom bag 20 may be removably affixed together as shown in various figures and installed within a bag filling frame 200. Sections of the combined top and lower bag sections may be positioned in the frame in an expanded orientation 50 with other sections in a collapsed orientation 58 as depicted in FIG. 1. Thus, long stretches of the combined bag may be installed within a frame for filling in rapid succession. The combined bags may be slidably retained within the frame 200 by a plurality of guides 38 which are received within guide receiving channels 50. The expanded bag section 50 may be placed under a funneled filling area of the frame so that sand or other fillable material may be deposited into the funnel area and fall directly into the expanded or opened section of the multi-part bag. Strap handles 52 and 54 may be positioned at various points on both the bottom bag 20 and the top bag 30 in order to aid in both the installation, assembly and then subsequent disassembly of the multi-part reusable levee bag 100.

The combined multi-part reusable levee bag may be slidably retained within frame and filled while the frame is slowly retracted backwards towards the collapsed section 58 of the combined top and bottom bag sections thereby producing a combined filled bag portion and unfilled bag portion as shown and illustrated in FIG. 2. The sled 200 may be retracted over the collapsed section in order to easily expand the collapsed bag section 58 into an expanded bag section 50 for filling as shown in FIG. 1, so that the filling operation may continue.

After filling of the bags in place, the combined multi-part reusable levee bag may act as a levee bag for flood control, retaining walls, earthen dam, erosion control, concrete walls, and other known uses. The multi-part bags may further be disassembled and reused by removing the fillable material therein without destroying the integrity of the bags.

As shown in FIG. 4, the top bag portion 30 may be detached from the bottom bag portion 20 by disconnection of the straps or detachment of other removably attachment or affixable structure. As shown, once the straps or other mechanism are detached, the top bag portion 30 may be lifted away from the bottom bag portion 20, thereby spilling the interior contents of the fillable material and allowing the top and lower or bottom bag sections to be reused. Straps 54 extending along the top edge of either side of the top bag may be utilized for raising the top bag 39 away from the bottom bad section 20 and allowing the contents therein to flow through the open bottom 35 and the top bag to be pulled away from the fillable material and bottom bag section. Remaining fillable material may be moved aside of the bottom bag portion 20 and the bottom bag portion may similarly be reused.

In various constructions, the top bag and bottom bad may be made of various materials including polypropylene, high strength canvas or the like. It may be desirable to incorporate material which is in impervious to water and which sufficiently retains the fillable material therein. The fillable material may include not only sand, dirt or other fill material but may also include concrete and the like should a permanent structure be required.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A reusable levee bag, comprising:

a top bag portion having an open top and an open bottom and a first end panel, said open top dimensionally smaller than said open bottom;

a plurality of guides extending from said top bag portion; said top bag defining an interior space;

a bottom bag portion removably retained to said top bag portion;

said bottom bag portion have a first side flap extending from a bottom panel and a second side flap extending from said bottom panel;

said interior space of said top bag interrupted by at least one baffle;

wherein said combined top bag portion and bottom bag portion define an enclosed levee bag capable of receiving flowable material.

2. The reusable levee bag of claim 1 wherein said bottom bag portion receives said top bag portion, said top bag portion removably retained to said bottom bag portion by a plurality of connectors.

3. The reusable levee bag of claim 1 wherein said top bag portion has a plurality of straps received within a plurality of strap receivers on said bottom bag portion.

4. The reusable levee bag of claim 1 wherein said bottom bag portion further has at least one end flap extending to said top bag portion.

5. The reusable levee bag of claim 1 wherein said top bag portion at least one baffle is a plurality of baffle panels extending from a first side of said top bag portion to a second side of top bag portion, said plurality of baffles positioned between said first end panel and an opposing second end panel of said top bag portion.

6. The reusable levee bag of claim 5 wherein said plurality of baffle panels extend substantially from said open bottom to said open top.

7. The reusable levee bag of claim 1 wherein said plurality of guides are a plurality of travel guides having a narrow neck and a ovalized head.

8. The reusable levee bag of claim 1 wherein said bottom bag portion is affixed to said top bag portion by a plurality of hook and loop fasteners.

9. The reusable levee bag of claim 1 wherein said bottom bag portion is affixed to said top bag portion by at least one removable affixation means.

10. The reusable levee bag of claim 1 wherein said bottom bag portion is tray shaped with said bottom panel and said first and second side flaps includes a first and a second end flap, said first and second side flaps and said first and second end flaps extending upward towards said top bag portion from said bottom panel to partially surround said top bag portion.

11. The reusable levee bag of claim 1 wherein said top bag portion is multi-sided.

12. The reusable levee bag of claim 11 wherein said top bag portion has a plurality of baffle panels within said interior space, said baffle panels quadrilateral in shape.

13. A reusable levee bag, comprising:

a top bag portion and a bottom bag portion, said top bag portion removably attached to said bottom bag portion;

said top bag portion having an open top and an open bottom, said open top dimensionally smaller than said open bottom;

wherein said top bag portion is removably retained to said bottom bag portion by a plurality of removably attachable mechanisms attaching the top bag portion to the bottom bag on;

said top bag portion and said bottom bag portion defining an enclosed interior forming a levee bag.

14. The reusable levee bag of claim 13 wherein said bottom bag portion has a first side flap and a second side flap extending over at least a portion of top bag portion.

15. The reusable levee bag of claim 14 wherein said top bag portion and said bottom bag portion are removably attached by a plurality of straps and rings.

16. The reusable levee bag of claim 14 wherein said bottom bag portion further has at least one end flap releasably attachment attachable to said top bag portion.

17. The reusable levee bag of claim 13 further including a plurality of quadrilateral shaped baffle panels in said enclosed interior.

18. The reusable levee bag of claim 13 further including a plurality of guides affixed to said top bag portion configured to allow said reusable levee bag to slide along a first and a second rail of a levee bag filling frame.

19. A two piece reusable levee bag, comprising:

a top bag section and a bottom bag section, said top bag section removably affixed to said bottom bag section;

said combined top bag section and bottom bag section forming an enclosed interior space having a plurality of baffles extending across the top bag section and forming individual compartments;

said top bag section having a narrow top opening and a bottom opening wider than said top opening;

wherein said combined top bag section and bottom bag section receives a flowable fill material;

said top bag section adapted to be removed from said bottom bag section when said flowable fill material is within said interior space thereby spilling said flowable fill material out of said interior space.

20. The two piece reusable levee bag of claim 19 wherein said top bag section has a multi-sided cross section.

21. The two piece reusable levee bag of claim 19 wherein said top bag section has a plurality of channel guides.

22. The two piece reusable levee bag of claim 21 wherein said channel guides each have a neck and head.

23. The two piece reusable levee bag of claim 19 wherein said bottom bag section has a bottom panel and a first and a second side flap affixable to said top bag section by a plurality of removably attachable fasteners.

24. The two piece reusable levee bag of claim 19 wherein said bottom bag section and said top bag section include a plurality of removably affixable fasteners allowing said top bag section to be securely fastened to said bottom bag section.

25. The two piece reusable levee bag of claim 19 wherein said top bag section has a plurality of straps received within a plurality of correspondingly positioned strap receivers on said bottom bag section.

26. The two piece reusable levee bag of claim 19 wherein said top bag section and said bottom bag section have hook and loop fasteners to removably retain said top bag section to said bottom bag section.

27. A two piece reusable levee bag, comprising:

a top bag having a top opening and a bottom opening and having front, back and first and second side panels;

a bottom section removably affixable to said top bag, whereby when said top bag is affixed to said bottom section, said combined top bag and bottom section form an enclosed interior space;

wherein said enclosed interior space is fillable through said top opening;

said enclosed interior space having a plurality of baffles;

said top bag removably attached to said bottom section by a plurality of connectors.

28. The two piece reusable levee bag of claim 27 wherein said plurality of connectors include a plurality of straps and strap receivers.

29. The two piece reusable levee bag of claim 27 wherein said plurality of connectors include hook and loop fasteners.

30. The two piece reusable levee bag of claim 27 wherein said enclosed interior space is capable of being filled with a flowable material through the top opening.

31. The two piece reusable levee bag of claim 30 wherein said top bag is removable from said bottom section after said interior space is filled with said flowable material.

32. A method of filling a reusable multi-piece levee bag, comprising:

removably attaching a top bag to a bottom portion, the top bag having an open top and an open bottom, the open bottom of the top bag substantially covered by the bottom portion;

wherein removably attaching the top bag to the bottom portion includes folding at least one side flap of the bottom portion to a first side of the top bag to removably affix the at least one side flap to said top bag;

slidably affixing the combined top bag and bottom portion to a bag filling frame;

expanding the combined top bag and bottom portion to define an interior fillable space by opening an open top of the top bag, the interior fillable space being substantially multi-sided in shape;

sliding the expanded top bag and the bottom portion within the bag filling frame and depositing filling material through the frame and into the interior fillable space;

removing the frame from the multi-piece bag.

33. A method of forming a multi-part reusable levee bag, comprising:

forming a substantially multi-sided top bag having a first and a second end panel and a first and second side panel;

interposing a plurality of baffle panels between said first and said second end panel to form individual substantially multi-sided compartments within said top bag;

removably affixing said top bag to a bottom section by folding at least one side flap of said bottom section against one of said first and said second side panel of said top bag;

wherein said combined top bag and bottom section form an interior space adapted for receiving a quantity of filling material.

34. The method of 33 wherein said removably affixing step includes sliding a plurality of straps into a plurality of strap receiving members.

35. The method of claim 34 further including folding a second side flap of said bottom section against an opposite of said one of said first and said second side panel of said top bag.

36. The method of claim 33 wherein further including folding an end flap of said bottom portion against said first end panel of said top bag.

* * * * *